United States Patent [19]

Akmese

[11] Patent Number: 4,873,796

[45] Date of Patent: Oct. 17, 1989

[54] DOME STRUCTURE

[76] Inventor: Kemal Akmese, 178 Flood Ave., San Francisco, Calif. 94131

[21] Appl. No.: 199,601

[22] Filed: May 27, 1988

[51] Int. Cl.[4] ..... E04B 1/32

[52] U.S. Cl. ..... 52/80; 52/227

[58] Field of Search ..... 52/80, 81, 82, 224, 52/248

[56] References Cited

U.S. PATENT DOCUMENTS

| | | | |
|---|---|---|---|
| 965,982 | 8/1910 | Beal | 52/224 |
| 2,036,363 | 4/1936 | Schaefer | 52/224 |
| 2,361,272 | 10/1944 | Covey | 52/82 |
| 2,820,990 | 1/1958 | Johnson | 52/80 |
| 3,085,366 | 4/1963 | Jamison | 52/81 |
| 3,119,153 | 1/1964 | Martin | 52/82 |
| 3,257,930 | 6/1966 | Averna | 52/81 |
| 3,284,969 | 11/1966 | Walters | 52/81 |
| 3,562,975 | 2/1971 | Moss | 52/80 |
| 3,958,375 | 5/1976 | Tully | 52/80 |
| 4,655,013 | 4/1987 | Ritland | 52/80 |

FOREIGN PATENT DOCUMENTS

| | | | |
|---|---|---|---|
| 625089 | 9/1961 | Italy | 52/80 |

*Primary Examiner*—Henry E. Raduazo

*Attorney, Agent, or Firm*—Thomas M. Freiburger

[57] ABSTRACT

A dome structure is formed of a large number of identical arcuate segments secured together at the edges, with no additional visible structural members between base ends and apex ends of the segments. A reinforcing ring may be secured to the dome structure at the base ends of the segments, and another may be secured at the apex ends, if the apex or top end of the dome has an opening. In preferred embodiments the arcuate segments are formed of laminated wood, with a spline or other type of overlapped glued connection between adjacent segments. At the edges of the segments, angularity varies from virtually perpendicular at the apex end to a maximum deviation from perpendicular at the base ends, and this is addressed by a special method of shaping the segment edges.

14 Claims, 6 Drawing Sheets

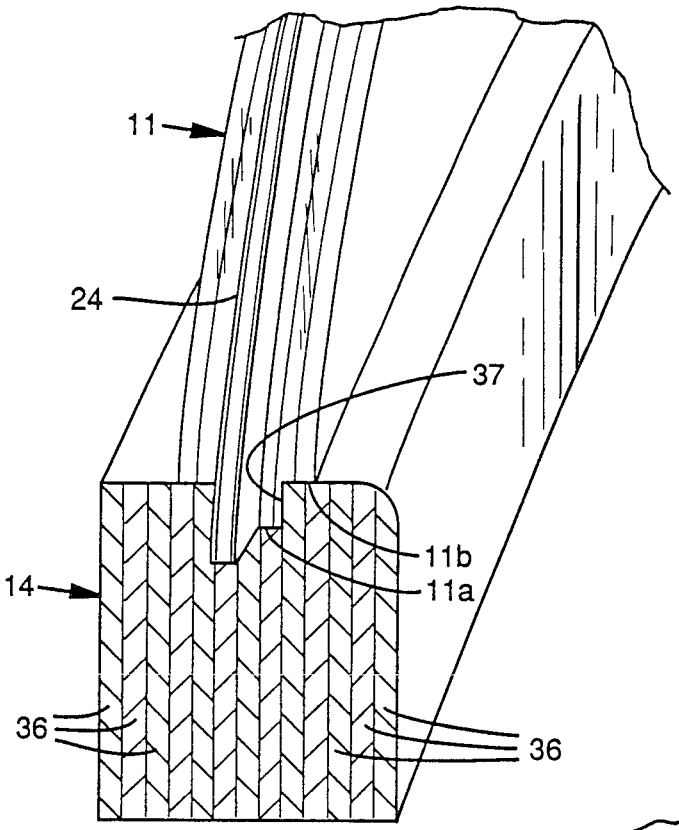
FIG. 9
FIG. 10
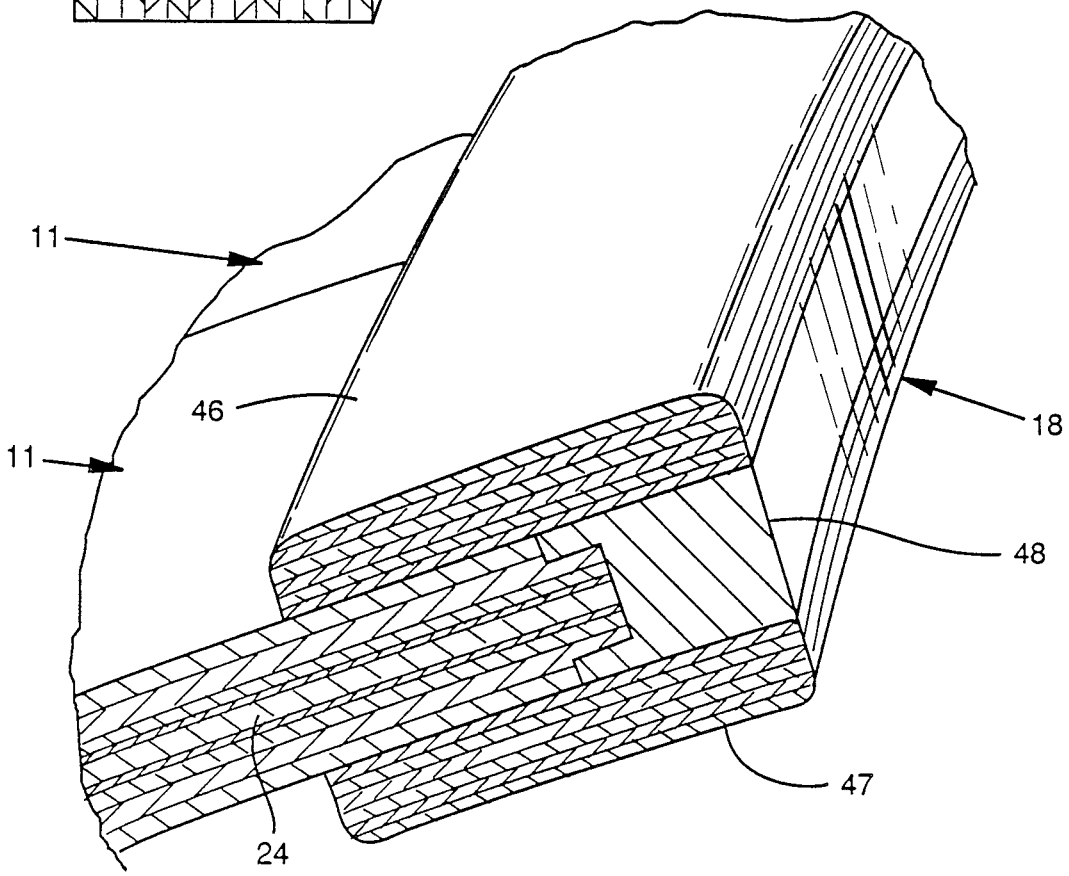

DOME STRUCTURE

BACKGROUND OF THE INVENTION

The invention is in the field of structures, and relates particularly to a dome or partial dome structure having a unique construction. The invention also encompasses a method for forming and assembling the dome structure.

Domes or dome-like structures are disclosed in prior (Krieg) U.S. Pat. No. 765,017, (Moss) 3,562,975, (Davis) U.S. Pat. No. 4,067,153 and (Wolde-Tinase) U.S. Pat. No. 4,400,927. These disclosures are pertinent to the present invention in that they describe various methods for constructing domes, but none discloses or contemplates the particularly advantages method and structure of the invention. The Krieg, Davis and Wolde-Tinase patents all involve structural ribs or circumferential beams which support separate surface members or skin.

The Moss patent is pertinent to this invention in that it describes a dome-like shelter with segments or panels which serve as structural elements in the support of the completed shelter. However, the panels in the Moss structure are flexible, manufactured flat and stressed into a bowed configuration upon erection. The edges of adjacent panels are not butted together or overlapped and secured together, and the edges are not complimentarily fitted. Rather, the adjacent panels are connected by separate flexible joint devices assembled to the panel edges upon erection of the shelter. Moss' structure has an entrance way interrupting the circumference of the dome and eliminating several segments. The highly stressed erected configuration of the Moss shelter, which contributes to structural stability, contrasts sharply with the dome structure of the present invention and underlies the different principles of support involved in the two dome configurations.

SUMMARY OF THE INVENTION

The dome structure according to the present invention avoids structural ribs, circumferential bands, special joints and interior structural members. Its multiplicity of edge-connected segments serve as a skin or surface and also as structural supports acting together to give the dome rigidity and strength. Requiring no separate joint connector devices, the edges of the adjacent segments are abutted or complimentarily fitted directly together. They may include splines fitted into grooves of the adjacent edges, or other grooved or lapped edge joining structure, glued together.

The dome or partial dome according to the invention preferably is a part of a sphere, with arcuate segments, but true arcuateness is not essential, and each segment can be, for example, a portion of an ellipse.

Each segment tapers from a maximum width at its base end to a minimum width at the apex end, which may come to a point or may be truncated, to form a circular opening at the apex or tip of the assembled dome structure.

At the joints between adjacent segments, the edges are connected directly to each other, being complementary shaped as mentioned above. This involves a change in edge angle from the base end to the apex. The angle between edge and face varies from a maximum deviation off perpendicular at the base end to near-perpendicularity at the apex end. The method of the invention includes a special procedure and system for shaping the edges to fit together in this way.

The dome structure in a preferred embodiment is of wood, with each segment pre-shaped to the arcuate configuration it will have in the assembled dome. The segments may be formed of glued laminated wooden layers. The outer layer or layers may be of weather-resistant wood, with the inner layers of other less costly varieties of wood. However, the principles of the invention apply to other materials as well.

A circular or arcuate reinforcing ring may be secured to the base ends of the segments to add circular integrity and for edge finishing at the base but not for structurally connecting the segments together in edge-to-edge position. Similarly, a ring may be secured at the apex ends of the segments if the dome's apex is open.

The number of segments forming the dome structure may vary from a minimum of about 18 to 100 or even more. In one preferred embodiment about 90 segments are used, requiring the segments to effect a 4° turn from segment to segment at the linear base ends. This can be accomplished with equal 2° deviations from perpendicular at both edges of each segment's base end, continuously varying to near-zero deviation at the apex end.

Dome-like structures which are not full hemispheres are within the principles of the invention. These may include shapes not truly arcuate from base to apex, half domes or other portions of domes, domes with apex openings or side openings, and other variations which still take advantage of the structural principles of the invention. A full sphere can be produced from two hemispherical domes in accordance with the invention.

Accordingly, it is among the objects of the invention to produce a dome-like structure which is simple and elegant in construction, comprising a multiplicity of edge-connected segments which give structural integrity as well as providing inner and outer surfaces, and without additional structural members between the base and apex ends of the segments. These and other objects, advantages and features of the invention will be apparent from the following description of a preferred embodiment, considered along with the accompanying drawings.

DESCRIPTION OF THE DRAWINGS

FIG. 9 is a partial view of a segment, in section, indicating connection to a bottom or base end ring which reinforces the base end of the assembled dome.

FIG. 10 is a partial sectional view similar to FIG. 9, but showing connection of a top or apex end ring to a segment.

DESCRIPTION OF PREFERRED EMBODIMENTS

Figure 1:
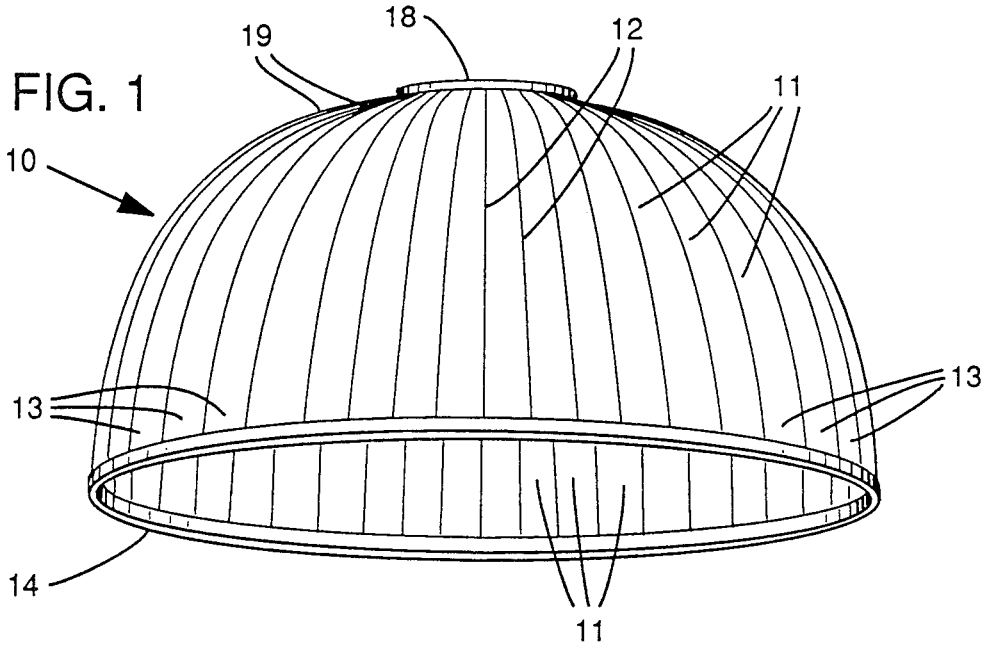
FIG. 1 is a perspective view of one embodiment of a dome structure constructed in accordance with principles of the invention.

In the drawings, FIG. 1 shows a dome structure 10 constructed according to the principles of the invention. The dome 10 includes a large number of segments 11 joined together at joints 12 lying in planes perpendicular to a plane of base ends 13 of the segments. The joint planes all intersect a center axis of the dome. Preferably a circular reinforcing ring 14 is secured to the base ends 13 of the segments. The ring 14 acts as a shape reinforcing means at the base of the structure.

Figure 2:
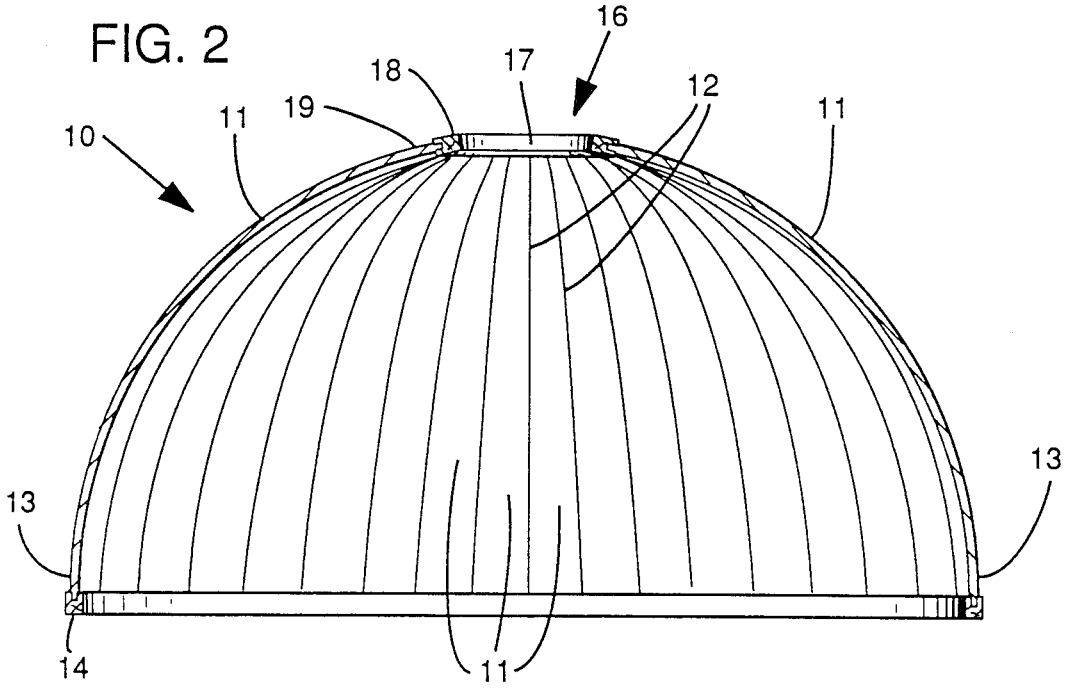
FIG. 2 is a sectional view of the dome structure shown in FIG. 1.

As shown in FIG. 2, an apex end 16 of the dome may have an opening 17 which may have a reinforcing ring 18 secured to apex ends 19 of the segments. In FIG. 2 the dome structure 10 is shown as a true hemisphere (or half of a true hemisphere), as is preferred, but the curvature of the segments 11 may be non-circular as discussed above.

Figure 3:
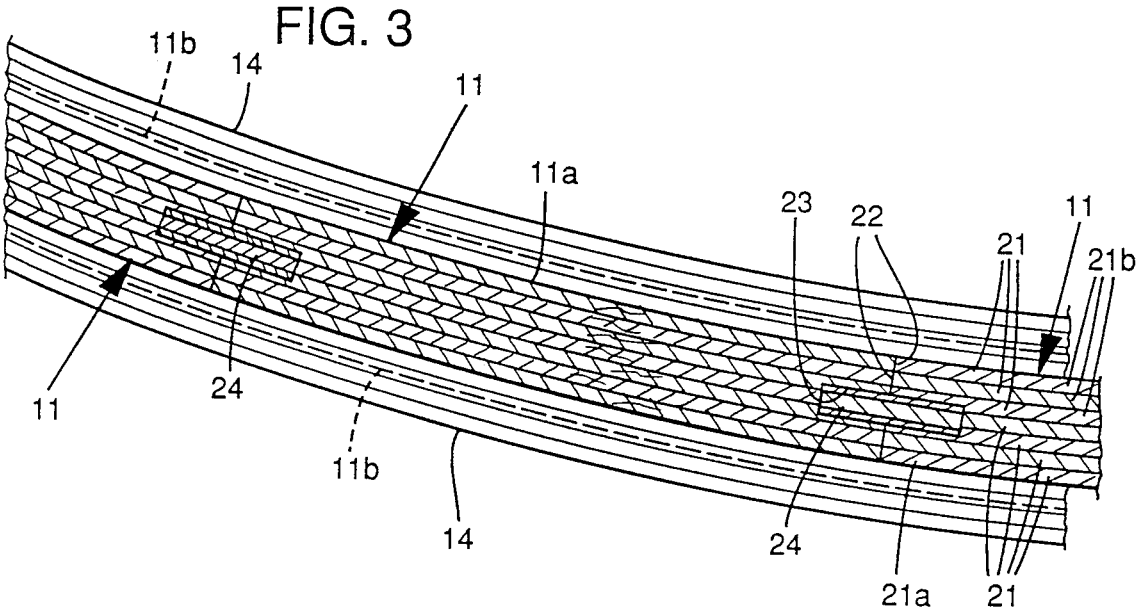
FIG. 3 is a sectional plan detail view showing an example of a laminated construction of the segments and one joint configuration for joining adjacent segment edges.

FIG. 3 illustrates that the segments 11, which preferably are pre-formed into their final curved configuration, may comprise glued laminations of a number of layers 21, laminated in the desired curved configuration. An outer layer **21*a* (or the outer two or three layers) may be formed of weather-resistant wood such as redwood or cedar, with inner layers 21*b*** of other varieties of wood, not necessarily moisture-resistant.

FIG. 3 also shows one manner of joining adjacent segments 11 according to the invention. Each edge 22 of a segment may be formed with a groove 23 (see also FIG. 4), and a continuous spline 24 may be fitted into the groove 23 and glued to join the edges. Other variations may also employed, such as butting, lapping or tongue-in-groove, but it is important that the edges 22 be substantially complimentarily shaped to one another, accommodating the angle that must exist between segments. An example of this angle is a total of 4° change in segment angle at each joint, for a dome with 90 segments. To produce this joint angle, each segment edge may be 2° off perpendicular (to the surface of the segment) at the base end of the segment. The formed angularity of the edge will include any groove 23 or lap jointing structure.

Figure 5:
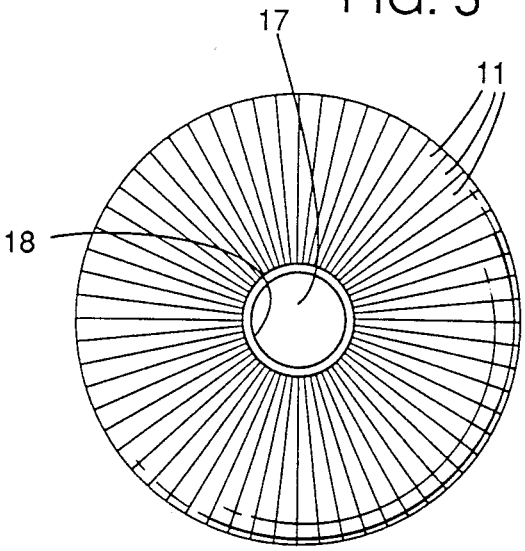
FIG. 5 is a partial plan view showing an open top or apex end of a dome, reinforced with a ring.
Figure 6:
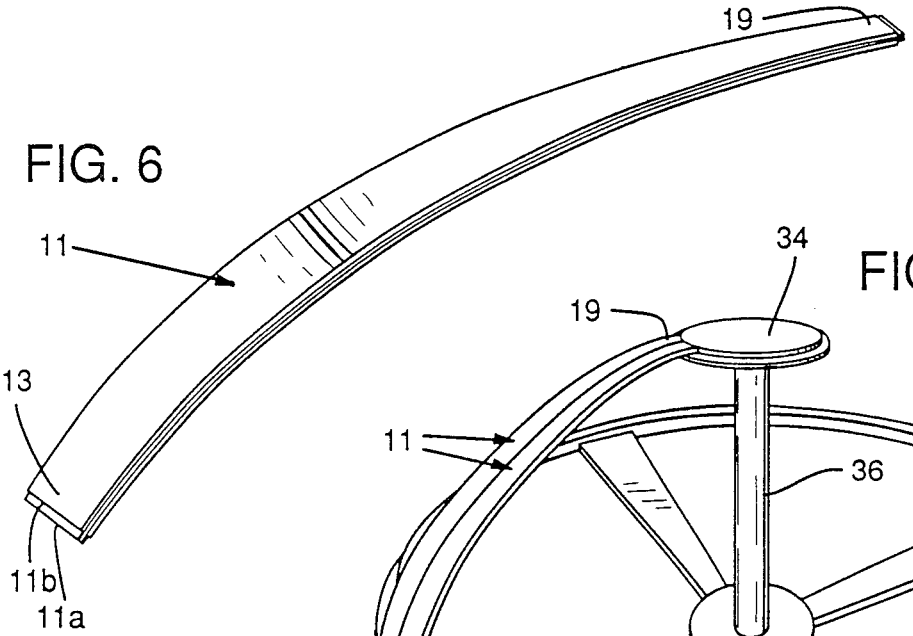
FIG. 6 is a perspective view showing one curved segment which may form a part of the dome structure of the invention.

However, the edge angle must vary continuously along the segment, reaching substantial perpendicularity at the apex ends 19 of the segments, as discussed above. If an opening 17 (FIGS. 2 and 5) forms the upper terminus or apex end 19 of each segment, then the edges will be very slightly off perpendicular at the apex end 19, and the end 19 will be truncated as shown in FIG. 6.

Figure 4:
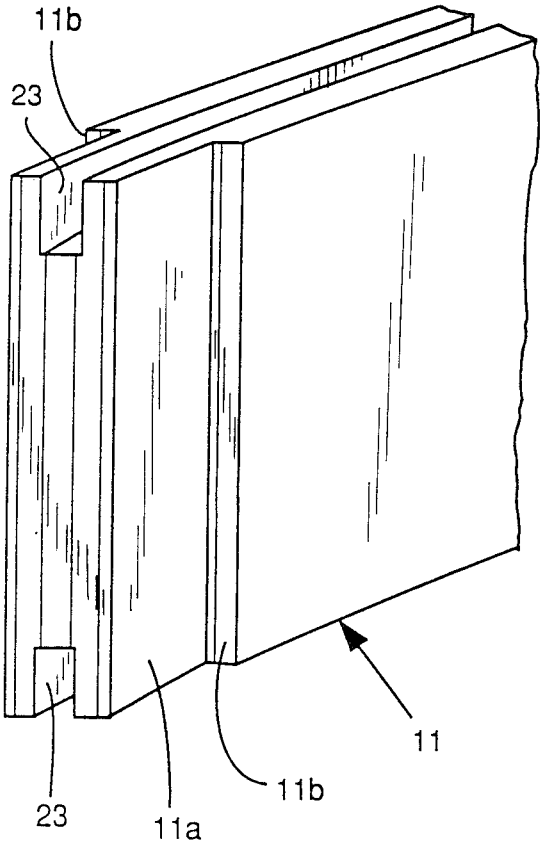
FIG. 4 is a perspective view showing one preferred configuration of edges and the base end of a segment.

FIG. 3, a sectional plan view taken just above the base ring 14, shows the base ring receiving the bottom end of the segment in a groove of the base ring. The bottom ends **11*a* of the segments may be narrower in thickness, as shown in FIG. 4, than the remainder of the section, so that inner and outer ledges 11*b* extend over part of the base ring 14**, covering the joint between the ring's groove and the segment.

Figure 7:
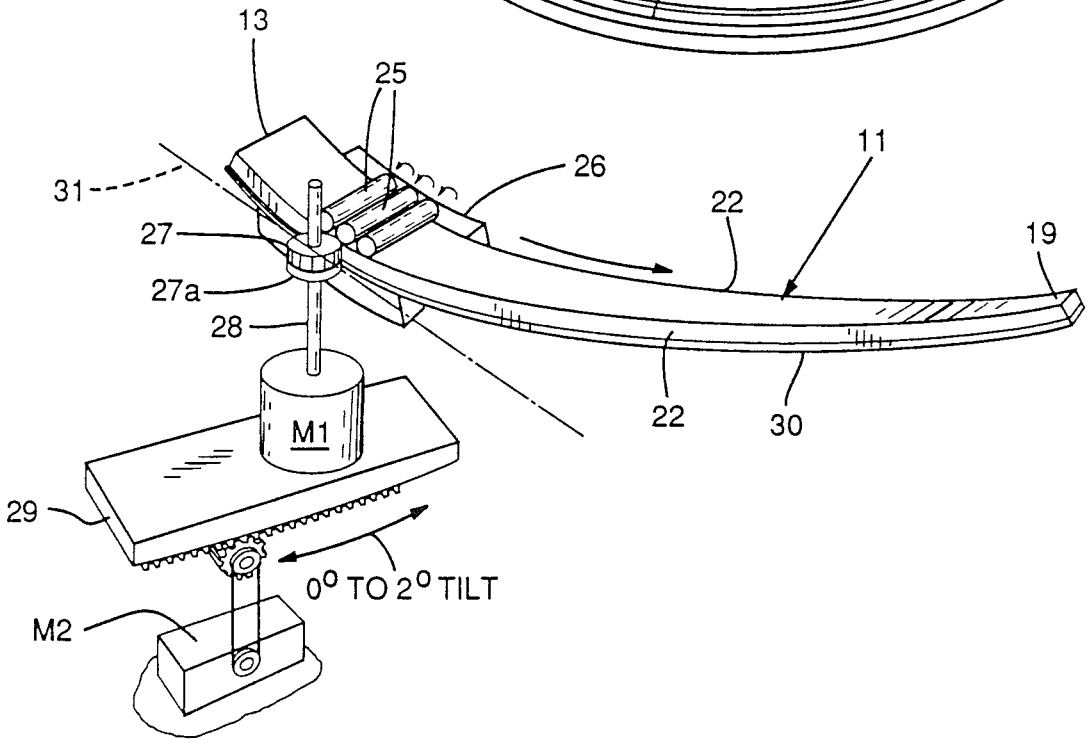
FIG. 7 is a schematic view in perspective view, showing a method of the invention for forming segment edges so as to be complimentary to adjacent edges in the assembled dome.

FIG. 7 shows a method according to the invention for forming the continuously varying angularity of the edges 22 of the dome segments. The figure schematically illustrates the advancement of a segment 11 through a work station by powered rollers 25 which frictionally engage the segment 11. The segment may slide on a curved, complementarily shaped support block 26 as indicated. As the segment advances, a router blade 27 on a shaft 28 revolves and removes material to shape the edge 22. The rotating shaft 28, however, changes its angular orientation as the segment advances in proper timing or phase with the advancing position of the segment.

In the example system illustrated, a motor M1 on a movable platform 29 drives the router shaft 28 and router blade 27. The platform 29 is mounted for pivotal movement about a pivot axis 31 generally parallel to the segment 11 at the area being routed, and generally through the router blade 27. A motor M2 fixed in position moves the platform about the pivot axes in timing with the progress of the segment-advancing rollers 25. The rollers 25 may be driven by the same motor M2 (by driving connections not shown), so that a fixed mechanical linkage exists between the movement of the rollers 25 and tilting of the router blade 27, or there may be a separate motor (not shown) for the rollers. In the latter case, the motors can be constant-speed motors which are geared to provide the proper speeds at the two locations and which are started and stopped at the proper time.

The segment 11 preferably has been rough cut to dimensions slightly wider than final dimensions, then a template 30 for the segment is attached to one side as illustrated. The router's following collar **27*a*** engages the edge of the template to guide the router to remove the desired amount of material.

In the example given above, with a two degree maximum deviation from horizontal at the base end of each segment edge, the router blade 27 will need to be changed in its orientation from near 0° tilt at the apex end 19 to 2° at the base end 13.

When one edge 22 of a segment 11 has been shaped by a pass through the system shown in FIG. 7, the segment may be turned around to feed the segment through in the opposite direction, base end 13 first. With the segments still concavely upward, this requires the tilting of the router to be opposite that used in forming the first edge—from 2° tilt to 0° tilt as the segment is fed through from end to end.

The router blade 27 can form any desired shape, depending on the joint configuration used. It may form an edge with a central continuous groove, or a lap joint, or a tongue or groove of a tongue-in-groove joint (see FIG. 12), with another router blade for the complimentary edge. Flat butt glue joints may be used if desired, although some form of interlocking or overlapping glue joint is preferable. The tongue-in-groove or splined joints are self-centering and therefore preferred.

The edges 22 of the segments 11 can be formed by another procedure in accordance with the invention, without the use of varying-angle router apparatus 27, 28, 29 illustrated in FIG. 7. After rough-cutting the segment larger than finished width dimensions (several can be cut out of a rectangular arcuately formed laminate with a table saw), the segment can be edge-trimmed with the template 30 attached by use of a fixed-axis router, generally as shown in FIG. 7 but without router tilt. This trimming operation will leave the segment width still slightly oversized. Then, the arcuate segment can be laid on one edge on a surface joiner table which is planar. Since the desired finished edge lies in a plane (each joint lies in a vertical axes plane as discussed above), the joiner can be used to form the edge into substantially a perfect plane. After one edge 22 is formed, the other can be formed similarly, with care to take the segment down to finished width and not further.

Thus, the template 30 plays an important part in forming the finished segment—by establishing the correct edge curvature, it establishes the plane in which the final edge should lie, found by laying the segment on an edge on a planar surface.

It should be noted that the segments, if developed or opened to a flat configuration, would not form trapezoid shapes. The long edges bulge outwardly, similar to lines of longitude on a hemisphere of a globe.

Figure 8:
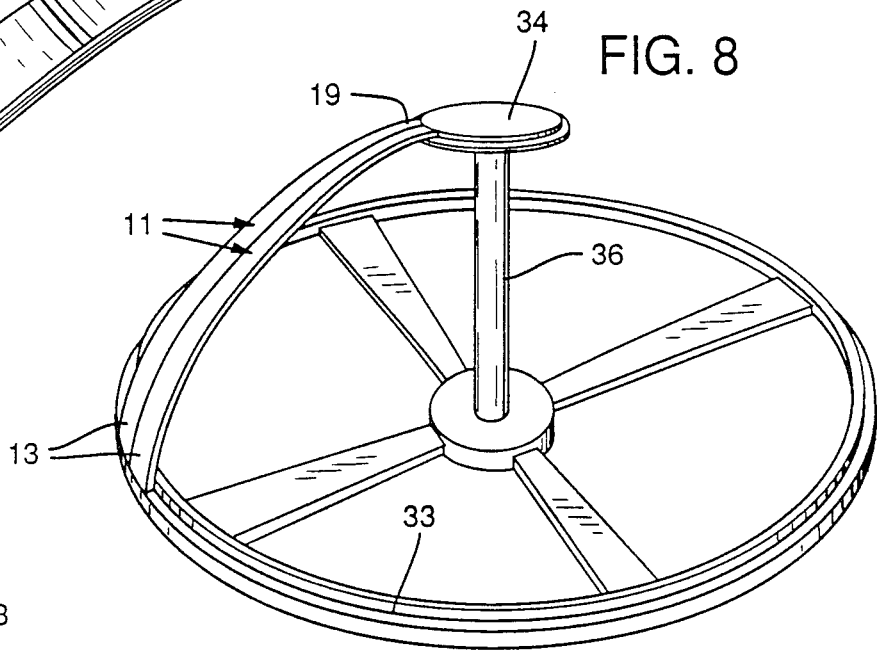
FIG. 8 is a schematic perspective view indicating layup of the segments in assembly of the dome.

FIG. 8 indicates an assembly layup arrangement whereby the base ends 13 of the segments are held in position by a base circular jig 33 while the segments are fitted together, and by an apex circular jig 34 at the apex ends 19 of the segments. The jigs 33 and 34 may actually comprise the reinforcing rings 14 and 18, respectively (or progressive sections as these rings are assembled), if these are to be included in the assembled dome. A central post 36 temporarily holds the top ring 34 in position with respect to the bottom ring 33 during assembly. This jig arrangement assures that the segments are assembled accurately in the desired dome configuration, without error buildup as assembly progresses. FIG. 5 shows the top or apex reinforcing ring 18 in plan view.

FIGS. 9 and 10 show examples of preferred constructions for the bottom and top reinforcing rings 14 and 18. The base ring 14 may be formed of a series of laminated layers 36, with a channel or groove 37 for receiving the narrowed end 11*a* at the base end of the segment 11. The apex ring 18 may be formed of three components—an outer piece 46, an inner piece 47 and a spacer piece 48 as shown. All three preferably are comprised of wood laminations, with laminated layers oriented differently in the spacer 48 than in the inner and outer pieces 46 and 47. The composite rings 14 and 18 may be secured to the segment ends 13 and 19 by any of several means, such as glue, mechanical fasteners or both. The rings may be formed in arcuate segments, such as four per ring.

Figure 11:
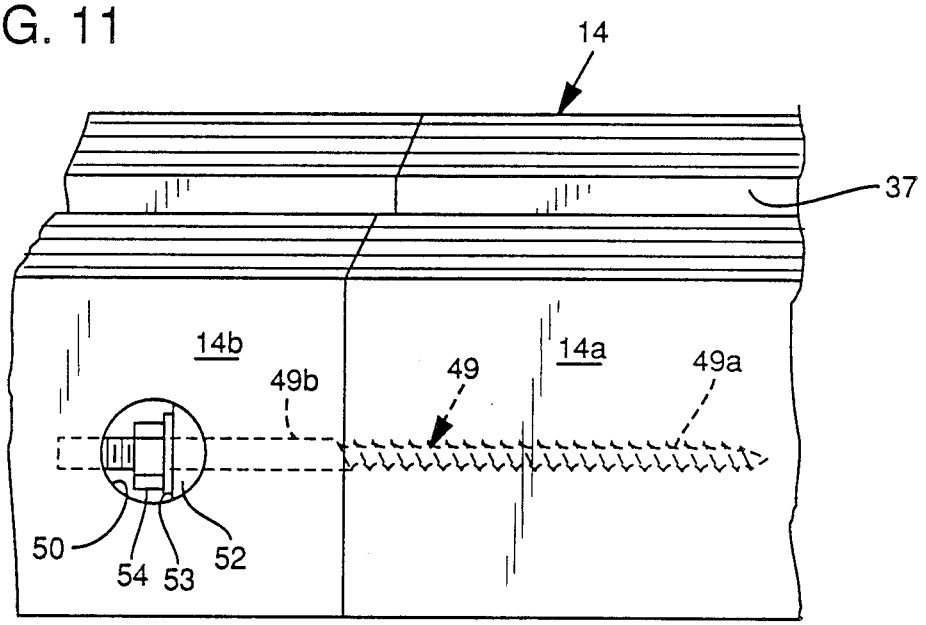
FIG. 11 is a perspective side view showing the joining of sections of the base end reinforcing ring.

FIG. 11 shows a preferred arrangement for connecting two adjacent ring segments of the base ring 14 together. Preferably a bolt or other fastener 49 is used in conjunction with gluing to secure the sections together. The bolt 49 has a woodscrew end 49*a* screwed into one section 14*a* of the base ring as illustrated. The other section 14*b* is pre-drilled to receive a machine bolt end 49*b* of the bolt 49 when the sections are put together. At a lateral opening 50 (which is later plugged) a wood spacer 52, washer 53 and nut 54 are assembled onto the machine bolt end, and the nut can be tightened by a striking tool from the opening 50. Portions of the base sections 14*a* and 14*b* (such as on either side of the groove 37) can be staggered at the joint if desired.

Figure 12:
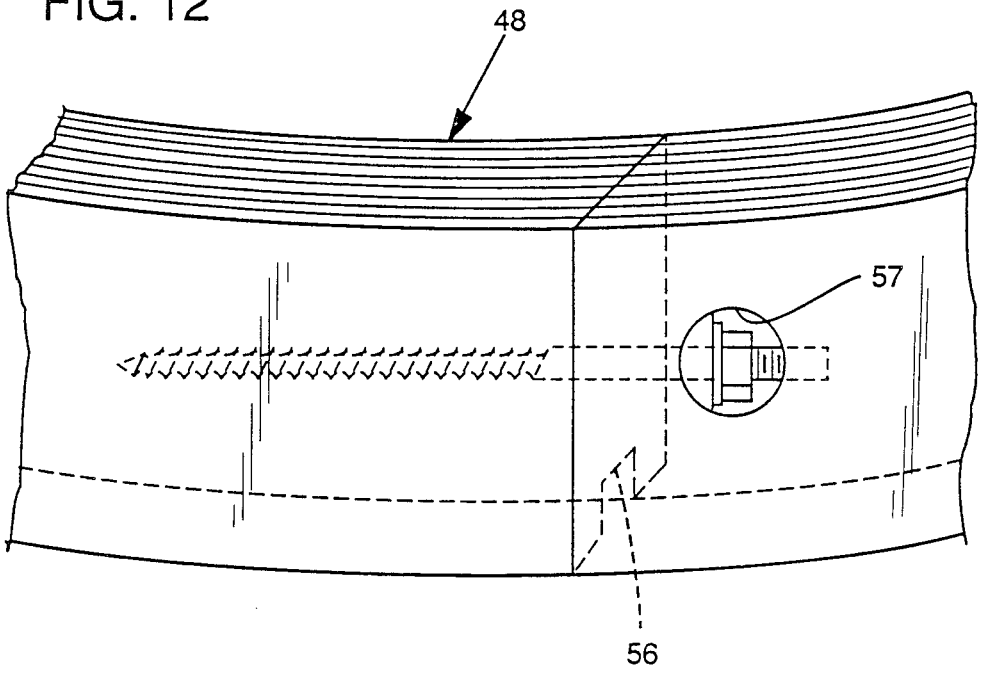
FIG. 12 is a perspective view showing assembly of a part of the apex reinforcing ring.

FIG. 12 shows a similar joint for two adjacent sections of the top ring, but involving only the middle or spacer piece 48. The middle piece 48 is assembled of sections progressively as the dome is assembled of segments, with the apex ends of segments fitting into a groove 56 of the middle piece 48. The outer and inner pieces 46 and 47 (see FIG. 10) are added and secured by gluing and bolting or screwing to the middle spacer piece 48. They are secured so as to stagger the joints of the middle piece 48, adding strength and covering bolt access holes such as at 57. The apex ring 18 may be built of four or more arcuate sections of each component.

Figure 13:
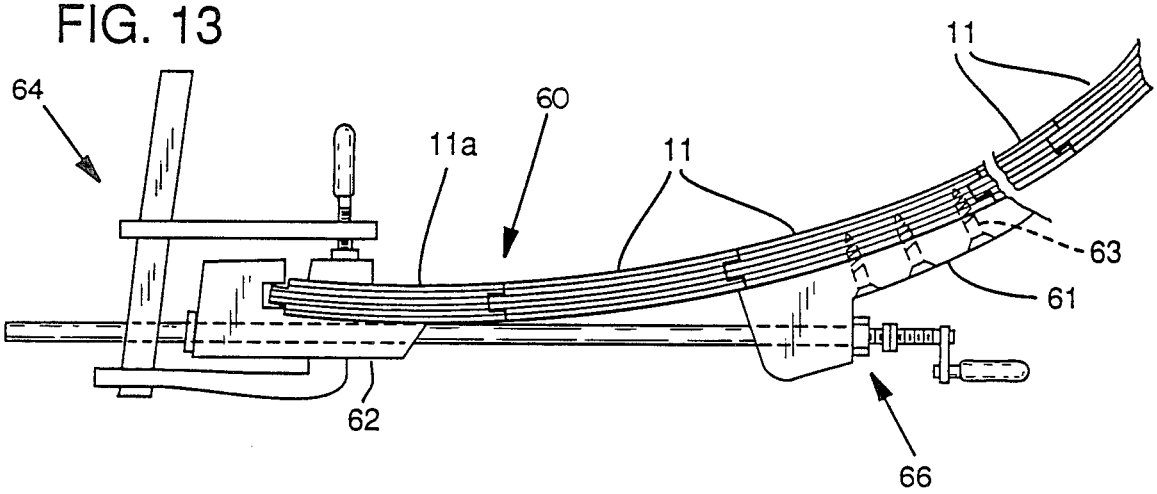
FIG. 13 is a sectional plan view showing several of these segments joined together and a system for temporarily clamping the segments to glue adjacent segments together.

FIG. 13 shows one method for holding adjacent segments tightly together at their edges during gluing of a joint 60. Jigs 61 and 62 are temporarily held to the segments as shown. The jig 61 is held by wood screws 63, which need not penetrate very deeply into the segments and form only a small hole which will virtually disappear later; the jigs 62 is held by a clamp 64 to a segment 11*a* being attached. The jigs are then clamped toward each other by a clamp 66. This may be done at two or three locations spaced vertically along the joint 60 to produce a glue joint of good integrity.

Figure 14:
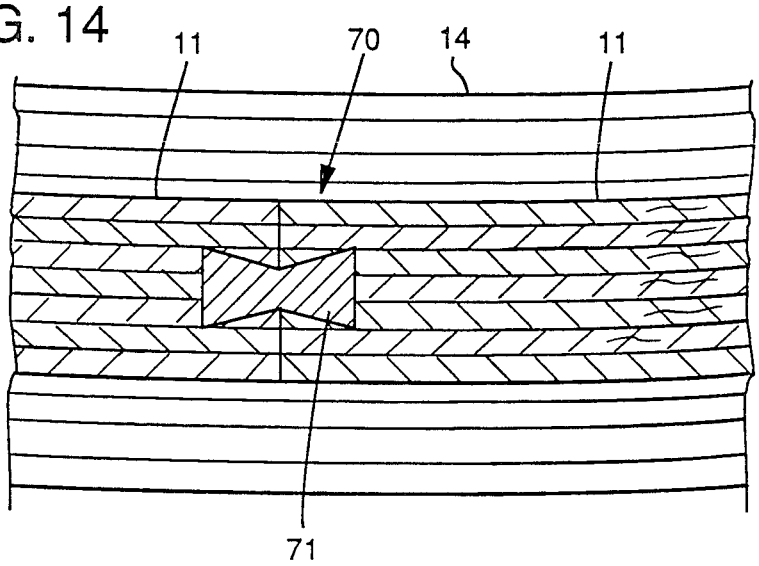
FIG. 14 is a sectional plan view showing an alternative system for adjoining segments of the dome structure together.

FIG. 14 shows an alternative type of joint 70 which may be employed to hold adjacent segments 11 together, particularly for situations where the dome is used in wet or severe weather conditions where glue joints would be subject to attack and possible deterioration. Dovetail grooves may be formed in each segment edge, and a long dovetail insert 71 may be pushed or driven through the length of the grooves, from base end to apex end. The dovetail insert may be of aluminum, copper or plastic rather than wood, for weather resistance.

Figure 15:
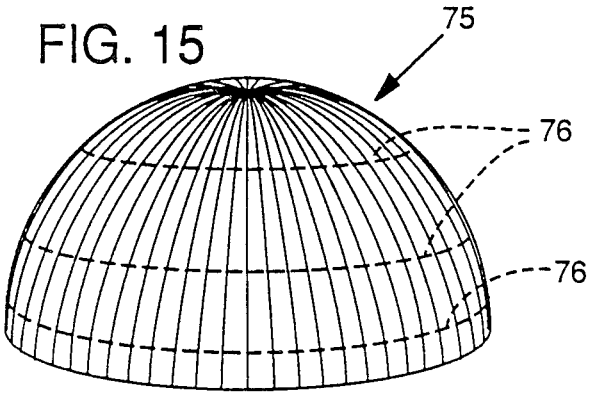
FIG. 15 is a perspective view of a dome showing a further alternative for joining segments together.
Figure 16:
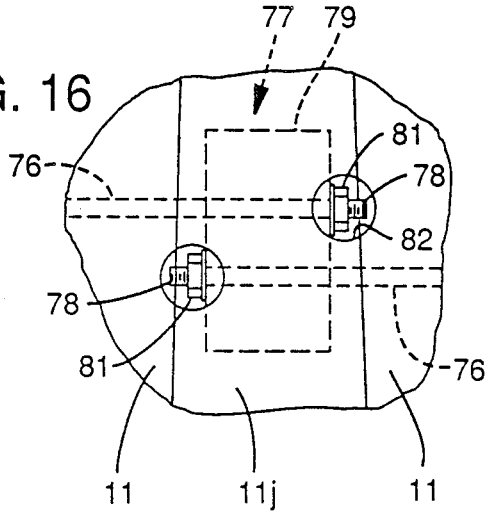
FIG. 16 is an elevation view, partially broken away, showing a feature of the joining system of FIG. 15.

FIGS. 15 and 16 show another system for drawing and holding the segments together. A dome 75, shown here as not having an apex opening (although it can have) may be held together by a series of tension bolts or cables 76, for example three cables spaced at different levels as illustrated. The cables pass through holes in each segment, with the last several segments holes on one side of a joint 77 inclining slightly upwardly or downwardly so the ends 78 of the cable/bolt can overlap as in FIG. 16. The segment 11*j* in which the joint occurs can have a steel reinforcement plate 72 inlaid, for bearing against by nuts 81 which draw the multiplicity of segments together into a tight circle. Nut tightening can be through access holes 82 in one face or the other of the dome. A turnbuckle could be used in lieu of the nut and steel reinforcing plate 77, still hidden from view in the segment(s). This system gives the dome high strength and integrity particularly in weather extremes, and can avoid any need for splined or tongue-in-groove edge connections, making assembly quite simple. Aesthetically, the dome 75 appears similar to the dome 10, since all hardware is hidden.

It should be understood that terms such as "dome" as used in this description are intended in a general sense, and not to limit the invention to a truly circular hemispherical dome. Also, terms such as "upper" and "lower," etc. are used only in reference to the drawings; the dome structure of the invention can be positioned in any orientation. Further, although equally-sized segments are shown, the widths of the segments can vary somewhat if desired. Also, an entry doorway can interrupt the dome structure if needed.

The above described preferred embodiments are intended to illustrate the principles of the invention, but not to limit its scope. Other embodiments and variations to this preferred embodiment will be apparent to those skilled in the art and may be made without departing from the scope of the invention as defined in the following claims.

I claim:

1. A dome-like structure, comprising, a large plurality of separately formed generally arcuate wood segments, preformed in said generally arcuate shape and essentially unstressed in the assembled dome-like structure, each subtending an arc from a base end of the segment and of the structure to an apex end of the segment and of the structure, each segment having outer and inner faces which taper in width from a maximum width at the base end of the segment progressively to a minimum width at the apex end of the segment, substantially each segment being connected at its two edges directly to two similar adjacent segments, one on either side, at joints lying in planes substantially perpendicular to a base plane containing the base ends of a segment, and the edges of adjacent segments being closely and substantially abutted, with the edge angle between the edge of a segment and a face of the segment varying from the base end to the apex end, from a maximum deviation from perpendicular at the base end to substantially perpendicular at the apex end, shape reinforcing means at least at the base ends of the segments, for reinforcing the shape of the base end of the structure, the structural connections between segments being made entirely via the edges of the segments, aside from the presence of said shape reinforcing means, and the segments together serving as structural supporting elements of the dome-like structure as well as inner and outer surfaces of the structure without any other structural framework or connection members on the inner or outer surfaces along or traversing the segments between the base ends and the apex ends.

2. The structure according to claim 1, wherein the shape reinforcing means comprises a base reinforcing ring generally at said base plane and secured to each segment at its base end, the segments forming a full circle at said base ends.

3. The structure according to claim 2, wherein the base reinforcing ring comprises a lamination of a series of thin wooden planks laminated in a curving shape and glued together.

4. The structure according to claim 2, wherein the apex ends of the segments together define an apex circle at which the dome-like structure terminates, so that the apex ends of the segments do not come together at a point and said minimum width being greater than zero and including an apex reinforcing ring secured to each segment at its apex end.

5. The structure according to claim 1, wherein each segment includes a spline member extending from an edge of the segment, and the adjacent segment having a longitudinal groove in its adjacent edge into which the spline is received and secured, connecting the edges of adjacent segments.

6. The structure according to claim 5, wherein each spline member is itself secured in a longitudinal groove of the segment from which it extends.

7. The structure according to claim 5, wherein each spline member comprises an integral tongue formed in the edge of the segment, each segment having one such edge and another edge with a groove.

8. The structure according to claim 1, comprising at least 18 segments.

9. The structure according to claim 1, comprising about 90 segments.

10. The structure according to claim 1, wherein each segment has edges which are about 2° off perpendicular at the base ends.

11. The structure according to claim 1, wherein each segment comprises a lamination of thin wooden strips, formed into arcuate configuration and glued together.

12. The structure according to claim 1, wherein the joints between adjacent segments have dovetail inserts running lenghtwise in the joints, with tapered grooves in each of the adjacent segment edges becoming wider in the direction away from the joint.

13. A dome-like structure, comprising, a large plurality of separately formed generally arcuate wood segments, preformed in said generally arcuate shape and essentially unstressed in the assembled dome-like structure, each subtending an arc from a base end of the segment and of the structure to an apex end of the segment and of the structure, each segment having outer and inner faces which taper in width from a maximum width at the base end of the segment progressively to a minimum width at the apex end of the segment, substantially each segment being connected at its two edges directly to two similar adjacent segments, one on either side, at joints lying in planes substantially perpendicular to a base plane containing the base ends of a segment, and the edges of adjacent segments being closely and substantially abutted, with the edge angle between the edge of a segment and a face of the segment varying from the base end to the apex end, from a maximum deviation from perpendicular at the base end to substantially perpendicular at the apex end, shape reinforcing means at least at the base ends of the segments, for reinforcing the shape of the base end of the structure, the segments together serving as structural supporting elements of the dome-like structure as well as inner and outer surfaces of the structure without any other structural framework or connection members visible on the inner or outer surfaces along or traversing the segments between the base ends and the apex ends, and including at least one circumferential tension cable holding the segments together, the cable being hidden in the segments, with hole through each segment from one edge to the other and the holes being aligned from segment to segment for passage of the cable, and with tightening means for drawing the cable ends togehter to draw the segments together in edge to edge compression.

14. The structure according to claim 13, wherein the tightening means comprises a steel plate inlaid in a segment and not visible from outside the dome with holes in the plate for receipt of the two ends of the cable, and threaded drawing means on at least one end of the cable for drawing the cable toward the steel plate to smaller diameter.

* * * * *